United States Patent [19]

Cole

[11] Patent Number: 4,598,723

[45] Date of Patent: Jul. 8, 1986

[54] MATERIAL APPLICATOR

[76] Inventor: Rodney D. Cole, 24 Pine Walk, Cobham, Surrey, United Kingdom

[21] Appl. No.: 657,767

[22] Filed: Oct. 4, 1984

[30] Foreign Application Priority Data

May 23, 1984 [GB] United Kingdom ..... 8413128
Aug. 1, 1984 [GB] United Kingdom ..... 8419571

[51] Int. Cl.[4] ..... A45D 40/30
[52] U.S. Cl. ..... 132/88.7
[58] Field of Search ..... 15/169, 206; 401/129; 132/88.7

[56] References Cited

U.S. PATENT DOCUMENTS 3,998,235 12/1976 Kingsford .
4,390,298 6/1983 Carluccio ..... 132/88.7
4,428,388 1/1984 Cassai ..... 132/88.7

*Primary Examiner*—Robert Peshock
*Attorney, Agent, or Firm*—Lerner, David, Littenberg, Krumholz & Mentlik

[57] ABSTRACT

The invention concerns an applicator for pasty, liquid or semi-liquid cosmetics materials such as mascara. Known applicators, in which an elongate applicator member formed integrally with a closure for a container of the material, may comprise a twisted wire brush carried at the end of a support shaft, have the disadvantage that the geometry of the brush is fixed. Thus a brush ideal for one type of application will be generally unsuitable for another. Other known applicators having fine end bristles suffer the problem that the bristles become damaged upon insertion through a narrow wiper opening of the material container. The arrangement of the invention avoids these problems by providing a cover for the material retaining part of the elongate member, relative movement between this cover and elongate member being permitted to provide selective and/or adjustable covering of the material retaining part. Thus, the amount of this part which is exposed for use can be varied. The configuration of the exposed part may also change.

20 Claims, 17 Drawing Figures

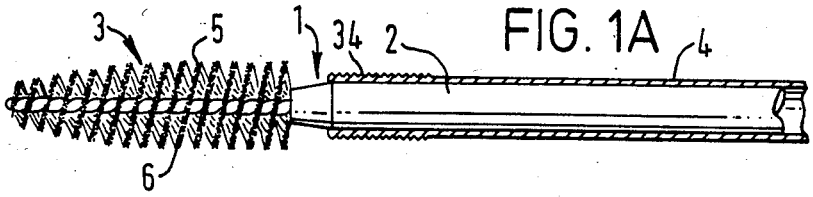
FIG. 1A
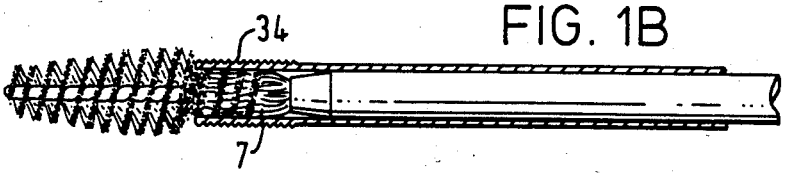
FIG. 1B
FIG. 2
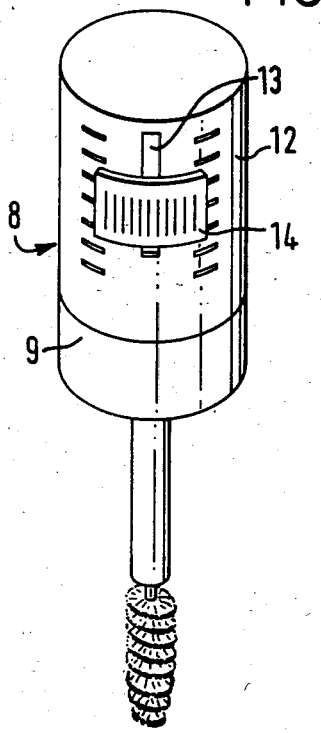
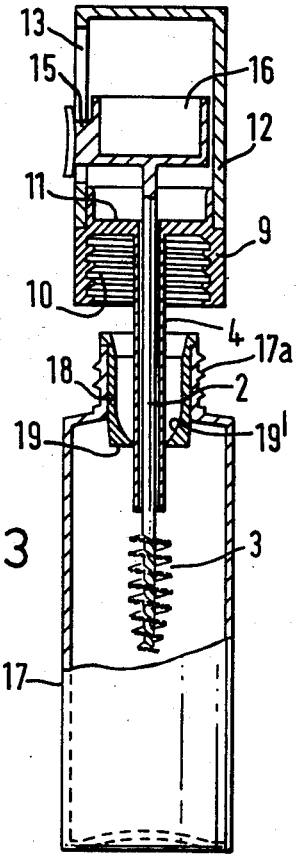
FIG. 3

FIG.4A
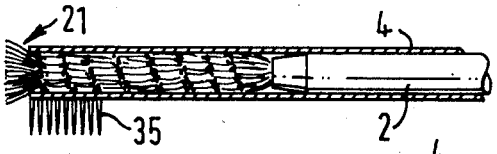
FIG.4B
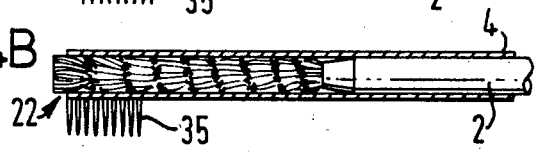
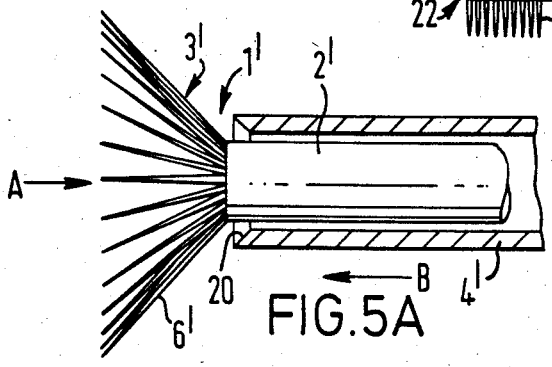
FIG.5A
FIG.6
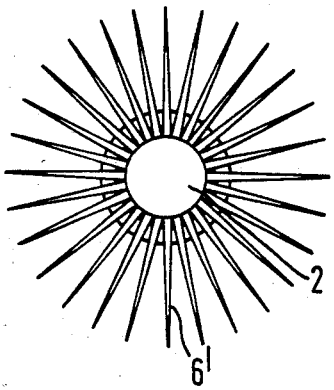
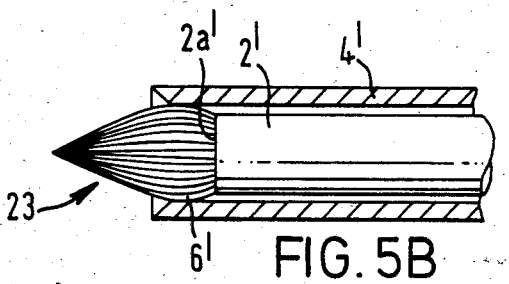
FIG.5B
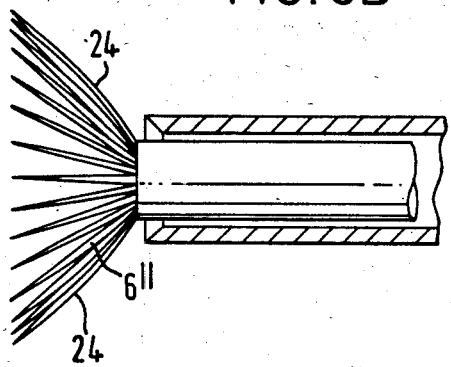
FIG.7
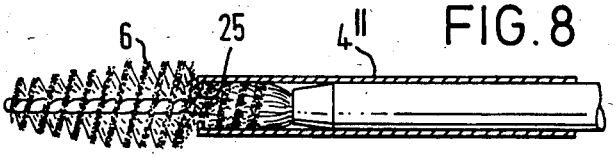
FIG.8

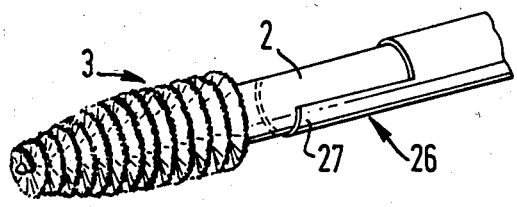
FIG. 9A
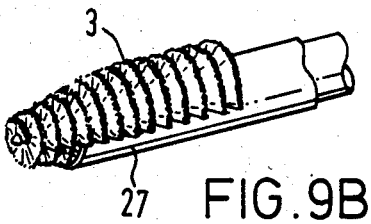
FIG. 9B
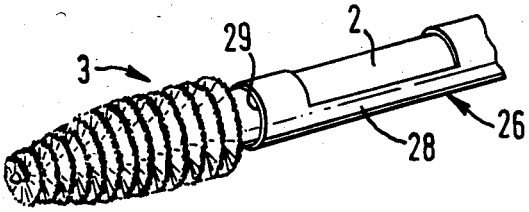
FIG. 10
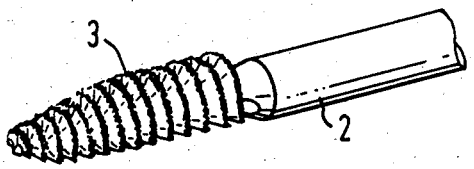
FIG. 11
FIG. 12A
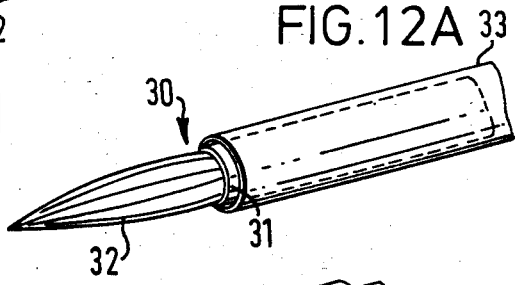
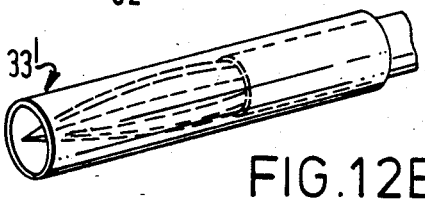
FIG. 12B

MATERIAL APPLICATOR

FIELD OF THE INVENTION

The present invention relates to material applicators, for example for the application of cosmetic material.

BACKGROUND TO THE INVENTION

Some existing applicators for viscous semi-liquid cosmetic products, such as mascara, have an elongate material-retaining portion having surface formations, for example radially projecting bristles, to hold the cosmetic product to be applied. Although this material-retaining and applying portion is generally designed for ease of application of the product, its shape and dimensions are fixed, thus restricting the versatility of the applicator for the application of the product in different circumstances. For example, while a relatively large stiff brush is best suited for applying mascara to the main upper eyelashes, a small delicate brush is best suited for the lower eyelashes. A conventional mascara applicator therefore has to be designed to have fixed shape and dimensions representing a compromise between these ideals, and the result is a construction which does not provide an ideal application action in either case.

U.S. Pat. No. 3,998,235 describes an applicator in which a material retaining portion having a plurality of axially spaced coating surfaces, e.g. a helical spring, can be compressed to change the axial spacing between these surface and thereby the material retaining capacity of the applicator. However, this arrangement requires a compressible form of retaining portion and only a limited degree of size variation of this portion is possible.

Other known applicators have flexible bristles extending from the end of an elongate shaft. For certain specific purposes, e.g. the application of eyeliner material to the eyelids, these bristles need to be very fine, and difficulties arise where such an applicator is supplied as part of an assembly comprising also a container for the material to be applied, the container accomodating in its neck a wiper member defining a wiper orifice for wiping the shaft clean on withdrawal from the container. The problem here, particularly where the bristles extend axially to form a fine end brush, is that unless extreme care is taken to align the bristles exactly with the orifice on reinsertion of the applicator into the container through the wiper these fine bristles tend to be pushed at some point against a surface of the wiper and thereby become misshapen. After repeated use, the brush tends to become permanently distorted and incapable of performing its intended purpose.

OBJECT AND SUMMARY OF THE INVENTION

The present invention is concerned with these problems in known applicators and seeks to overcome them by providing for adjustable covering of the material retaining portion and thereby adjustment of the degree of exposure and/or shape of this portion.

According to the invention, therefore, there is provided an applicator for the application of material such as cosmetic products comprising an elongate member having a portion for retaining the material, and means movable relative to the said elongate member for selectively and/or adjustably covering said material-retaining portion so as to alter the degree of exposure and/or the configuration of said material-retaining portion.

The material-retaining portion may, for example, comprise an elongate brush in which bristles project axially or radially outwardly from a central stem, the adjustable covering means comprising a sleeve coaxial with said stem, said brush and sleeve being relatively axially displaceable so as to vary the length of a portion of said brush concealed within the sleeve and thereby also the length of the usable portion of the brush exposed beyond the end of the sleeve. This sleeve may be slidably carried on an elongate shank which forms part of said member, and from one end of which the brush projects.

An opening of said sleeve into and from which the material-retaining portion passes for said variable covering may have a diameter smaller than that of the shank so as to provide a cleaning action for the portion of the brush adjacent the central stem.

The outer surface of the end portion of the sleeve which variably covers said material-retaining portion may be adapted to provide an alternative form of material-retainer/applicator.

The applicator preferably also includes a handle portion from which said member projects, said handle portion being provided with manually operable means for adjusting the relative position of said variable covering means and said member, so as to provide said variation of configuration.

Instead of comprising an elongate brush-like member, the material retaining portion may comprise an element or elements projecting outwardly from a central stem, the shape of this portion being varied as it is progressively covered by the variable covering means. This projecting member may, for example, be the end bristles of an elongate brush, or end bristles alone, these bristles being deflected so as to project axially from the end of the member as their radially inner portions enter the variable covering means. The arrangement may be such that the bristles are deflected so as to cause their tips to meet beyond the end of the central stem in a converged configuration to provide an inner reservoir for the material to be applied.

In another form, the material retaining portion comprises flexible elements projecting axially from the end of an elongate shaft, e.g. bristles forming a fine end brush for fine eye make-up application. The covering means may again be a sleeve slidable axially of the shaft. The principle purpose of the sleeve in this embodiment is to protect the delicate bristles from damage during reinsertion of the application through a wiping orifice of a wiper mounted on the neck of a container for the material to be applied. Accordingly, the sleeve is moveable relative to the applicator from a brush-exposure position to a brushenclosing position. Intermediate positions can provide differing lengths and firmness of end brush as required.

BRIEF DESCRIPTION OF THE DRAWINGS

Preferred embodiments of the present invention will now be described by way of example with reference to the accompanying drawings in which:

FIGS. 1A and 1B illustrate in longitudinal part section an applicator according to the present invention in respective different conditions of brush exposure;

FIG. 2 illustrates in perspective a cosmetics applicator including the components illustrated in FIG. 1 and a manually operable actuator mechanism;

FIG. 3 is a longitudinal, part sectional view of the cosmetics applicator shown in FIG. 2 shown in combination with a container for the cosmetics material to be applied by the applicator;

FIGS. 4A and 4B illustrate in longitudinal part section a modified applicator according to the present invention in respective different conditions of end bristle shaping;

FIG. 5A is a longitudinal sectional view illustrating another applicator in accordance with the present invention;

FIG. 5B is also a longitudinal sectional view showing the applicator of FIG. 5A in a bristleadjusted condition providing a reservoir for the material to be applied;

FIG. 6 is an end view illustrating the applicator shown in FIG. 5A when viewed in the direction A, FIG. 7 is another longitudinal sectional view showing a modified applicator according to the invention with shaped bristles;

FIG. 8 is a longitudinal sectional view showing a further applicator according to the invention with a modified sleeve;

FIGS. 9, 10 and 11 are perspective views showing other applicators according to the invention with further modified forms of sleeve; and FIGS. 12A and 12B are perspective views showing another applicator according to the invention with covering sleeve, illustrated in brush-exposing and brush-protecting positions, respectively.

DETAILED DESCRIPTION OF THE PREFERRED EMBODIMENTS

With reference first to FIG. 1, the essential components of this first embodiment of the invention comprise an elongate applicator member 1 having a shaft portion 2 from one end of which projects a cosmetics material-retaining and applicating element 3 in the form of a bristle brush, and a tubular sleeve 4. This sleeve is coaxial with the shaft 2, and has an inside diameter to allow relative longitudinal sliding movement between said sleeve and shaft. In this embodiment, the brush comprises a multiplicity of bristles 5 rooted in a twisted wire stem 6. At its outer end, the brush tapers slightly, as shown.

In the condition illustrated in FIG. 1*a*, the sleeve is in a relatively retracted position so that the whole of the length of the brush 3 is exposed and usable for the purpose of cosmetics application, for example for the application of mascara or other pasty, liquid or semi-liquid cosmetics product to the eyes. In the condition shown in FIG. 1*b*, the sleeve 4 has been moved forwardly, or the elongate applicator member moved rearwardly, so that a rear portion 7 of the brush 3 is covered by the forward end of the sleeve, so as to reduce the length of the brush now exposed and usable for cosmetic application.

FIGS. 2 and 3 illustrate an example of an arrangement in which the essential components illustrated in FIG. 1 have been incorporated in a manually actuable cosmetics applicator integrally constructed with a closure cap for the container of the cosmetics product. The cap 8 comprises a lower portion 9 which is internally threaded at 10 to screw onto a correspondingly externally threaded neck 17A of a cosmetics container 17. This lower portion 9 is integrally formed adjacent the internal end of the screw-threading 10 with a transverse annular closure ring 11 which, when the cap is screwed onto the container neck seals the container opening. The sleeve 4 of the FIG. 1 arrangement is integrally formed with this closure ring 11 and projects therefrom axially through the lower portion 9 to extend into the interior of the container.

An upper, generally cylindrical cap portion 12 is attached to the lower portion 9, and is formed with an elongate axially extending slot 13 in its side wall. A manually engageable slider member 14 exposed outwardly of the cap is joined by a joining web 15 projecting through this slot 13 to an internal, generally cylindrical plunger member 16 which can move axially within the upper cap portion 12. The shaft portion 2 of the FIG. 1 arrangement is formed integrally with and projects axially from, this plunger member 16 into and through the sleeve 4 to emerge from the lower end of this sleeve, the brush 3 projecting from the lower end of the shaft 2. The shaft 2, plunger 16, joining portion 15 and slider member 14 are preferably of integrally formed, one-piece construction.

In FIG. 3, the slider member 14 is at or adjacent the lower end of the slot 13, and the whole of the length of the brush 3 is exposed beneath the lower end of the sleeve 4. By manually moving the slider member 14 upwardly, the brush can be fully or partly withdrawn into the lower end of the sleeve 4 so as to provide the variable covering of the brush, and thereby the adjustment of the usable exposed part thereof as described previously with reference to FIG. 1.

It will be appreciated that other manually operable arrangements can provide the required brush adjustment. For example, the sleeve and shaft may be relatively axially movable by relative rotation of upper and lower parts of a split container applicator cap. In both this and the above described arrangement a scale may be provided on the cap to indicate the adjustment condition to the user when the applicator brush is within the container.

As shown in FIG. 3, the container 17 for containing the product to be applied by the applicator/cap assembly has an annular wiper unit 18 inserted into its externally screw-threaded neck, this wiper unit having at its inner end a wiping orifice 19 of substantially the same diameter as the outer diameter of the sleeve 4. As the applicator is withdrawn from the container, first the sleeve 4 and then the brush 3 pass through and are wiped by the wiper orifice 19. This cleans the outer surface of the sleeve 4 and removes excess material from the brush 3.

The above described embodiment can be used in various different ways. In one mode, the length of the brush is adjusted by appropriate movement of the slider member 14 prior to removal of the applicator from the container, whereas in a second mode, the adjustment can be made after such removal so as to move the cosmetics material forwardly from a rear part of the loaded brush. This latter mode provides for the consumer to supply the product to that part of the brush most suited for the particular area to which the product is to be applied.

The essential purpose of the arrangement described above is, as explained, to provide adjustement of the usable length of the applicator brush. However, additional or alternative operational features can be obtained in this, and modified arrangements. For example, it can be arranged that the variable covering of the bristles of the brush causes variation of the angle at which the bristles stand in relation to the brush stem. This is particularly applicable for the end bristles which, as illustrated at 21 in FIG. 4A, can be deflected forwardly into a conical configuration. A slight further withdrawal of the brush into the tube will cause further deflection of these end bristles so that their exposed portions form a parallel, axially extending configuration to provide a stubby brush, particularly suitable for the application of small quantities of cosmetics material in closely confined spaces, for example to the eyelashes at the corners of the eye nearest to the bridge of the nose. This latter bristle arrangement is illustrated 22 in FIG. 4B.

FIG. 5 illustrates another embodiment in which an elongate applicator member 1' comprises a shaft 2' and a material-retaining and applicating portion 3' in the form of a single ring of tapering end bristles 6'. These bristles 6' may be of plastics material integrally molded with the central shaft 2', and in their unconstrained condition project forwardly and obliquely relative to the shaft axis, as shown in both FIGS. 5A and 6. A sleeve 4' is slidably fitted over the shaft 2', and the forward end of this sleeve 4' is bevelled inwardly to provide an oblique inwardly and rearwardly slanting frusto-conical surface 20.

As the sleeve 4' is moved forwardly in the direction of the arrow B relative to the shaft 2', for example by means of a manually operable arrangement similar to that of the embodiment of FIGS. 2 and 3, this surface 20 comes into contact with the outer surfaces of the ring of bristles 6' and deflects them progressively inwardly so as to progressively reduce the extent of their radial outward projection. Variable factors such as the shape of the individual bristles 6' and of the bristle-deflecting surface 20 will determine the manner in which the bristles deflect upon further forward movement of the sleeve 4' (or, of course, rearward movement of the shaft 2'). As described before, it may be arranged that the bristles eventually form a stubby brush of forwardly projecting bristles somewhat as illustrated in FIG. **4*b*. Alternatively, it may be arranged that the bristles will eventually deflect inwardly so that their tips meet on the axis of the shaft so as to form a pointed brush, the roughly conical space 23 formed within the curtain of the inwardly deflected bristles between the meeting point of their tips and the flat circular end surface 2*a'* of the shaft 2** forming a reservoir for the product to be applied.

Once again, the features of the FIG. 5 embodiment can provide different advantageous operational features depending upon how the applicator is used. For example, the applicator can be manually adjusted to the FIG. **5*b* condition whilst still in the container so as to form and fill the reservoir with the cosmetics material before withdrawal. Alternatively, if only a small amount of cosmetics material is to be used, the applicator can be withdrawn so that the bristles are wiped by the wiping orifice, and then adjusted to form the brush, in which case the reservoir 23** will contain little or no material to replenish the brush once the material retained on the bristles has been used.

To provide this reservoir-forming action, the outer edges 24 of the bristles 6'' may be slightly convex curved, as shown in FIG. 7.

In the above-described embodiments, the forward end of the sleeve 4, 4' may be provided with surface formations so that in its relative forward position it provides an alternative form of material-retaining/applicating member to that carried by the central shaft 2, 2'. For example, the sleeve may be formed with circumferential grooves 34 (see FIG. 1) to form a roller, or teeth 35 in a single row to provide a comb (see FIG. 4), or bristles to provide an alternative brush. In the latter case, the bristles can be integrally molded with the sleeve as linear or radial or conventional bristles.

Furthermore, as shown in FIG. 8, the sleeve 4'' may be modified by forming it at its forward end with a reduced diameter aperture 25. This adaptation serves the additional useful purpose of providing a cleaning action so as to clean the inner portion of the brush 3 lying adjacent the central stem 6 of the cosmetics product as it enters the sleeve. This effect is particularly beneficial as this portion of the brush is not normally wiped by the wiper orifice 19 of the wiper insert 18, since this wiper orifice will be of roughly the same diameter as the outer diameter of the sleeve 4.

In another embodiment illustrated in FIG. 9 an adjustable covering of the brush 3 projecting from the end of the shaft 2 is provided by a covering member 26 in the form of a sleeve the outer end of which is part cutaway to leave a part-cylindrical end portion 27. Once again, the applicator 1 and the covering member 26 are relatively axially displaceable to provide adjustable covering of the brush 3. In the position shown in FIG. **9*a* the brush 3 is fully exposed beyond the end of the cover member 26. As the brush withdraws relative to the member 26, a circumferential part of the brush (the lower half, as shown) is progressively covered by the end cover portion 27 leaving the remaining circumferential part (the upper half) exposed as shown in FIG. 9*b*, in the illustrated embodiment the axial lengths of this portion 27 and the brush 3 are roughly equal, so that a full-length, part circumferentially covered brush can be obtained. Other length ratios can, of course, be used as required. It may be arranged that the brush 3 can withdraw further from the FIG. 9*b* position into the non-cutaway part 26' of the sleeve 26. If the outer part cylindrical surface of this end portion 27 is provided with surface formations e.g. circumferential grooves, two different types of applicator surface can be obtained at the same end portion of the applicator when the brush is axially coincident with this portion 27**.

Alternatively, as shown in FIG. 10, an intermediate sleeve portion 28 may be cutaway so as to provide both the advantages of the earlier embodiments where the end bristles can be adapted, as shown in FIGS. **4*a* and 4*b* to provide an adjustable end brush, and of the FIG. 9 embodiment where a longer brush can be obtained, only part of its circumference being exposed. This is possible because by providing the cutaway portion 28 spaced from the end of the sleeve, a circumferentially complete orifice 29** can be provided at that sleeve end to perform the end bristle flexing described earlier.

It will also be appreciated that although in all of the above embodiments the adjustment of brush exposure is achieved by relative axial movement of the covering member and the applicator, such adjustment may in some cases be achieved by relative rotation only. For example if the FIG. 9 arrangement were to be modified by axially bisecting the brush to obtain a generally semi-cylindrical brush as shown in FIG. 11, and by positioning this brush at an axially fixed position coincident with the end portion 27, relative rotation of the modified brush 3' and the member 26 will provide adjustment between full brush exposure and full brush covering.

With reference now to FIGS. **12*a* and 12*b*, an applicator 30 is shown which comprises an elongate shaft or shank 31 one end of which carries a fine brush 32 of flexible elements, in this case bristles, extending axially from that end of the shaft. The bristles may be integrally formed with the shaft, or may be fixedly planted e.g. by adhesive, in a recess formed in the end of the shaft. As explained earlier, a problem with this type of applicator is that the fine brush 32 tends to become damaged by bristle distortion as it is reinserted through a wiper (e.g. of the type illustrated in FIG. 3**) located in the neck of a container with which the applicator forms a cosmetics assembly.

More particularly, the tips of the bristles will tend to impact against the surfaces 19' surrounding the wiping orifice 19 (see FIG. 3) upon such reinsertion causing deformation of the bristles and permanent misshaping of the brush.

In accordance with the invention, a selective covering means is provided in the form of a sleeve 33 disposed about, and moveable axially relative to the shaft 31. An arrangement similar to that illustrated in FIG. 3 may be provided for causing the relative axial movement between the shaft and the sleeve. In one extreme position of the sleeve, shown in FIG. 12*a* the brush 32 is exposed for use; in the other extreme position, shown in FIG. 12*b*, the sleeve covers the brush completely and thereby protects the bristles.

In use, the sleeve or shaft can be moved to the brush exposing position of FIG. 12*a* or an intermediate partial exposure position prior to removal of the applicator from the container so that the brush will be withdrawn loaded with the cosmetics material from the container. The applicator can then be used with the brush either fully or partially exposed. After use, the shaft 31 is withdrawn, or the sleeve 33 pushed forward to the brush-enclosing and protecting position of FIG. 12*b*, and the applicator 30 can then safely be reinserted into the container through the wiper without damaging the fine bristles, as the brush 32 is disposed entirely within, and protected by the sleeve.

On withdrawal of the applicator the wiper serves to clean the outer surface of the sleeve 33 of the cosmetics material adhering thereto.

Again, the outer surface of the forward end 33' of the sleeve 33 may have surface formations, e.g. circumferential grooves (not shown) providing an alternative material-retaining portion to that provided by the fine brush 32.

While several embodiments have been shown to illustrate the invention, it will be understood by those skilled in the art that various changes and modifications can be made without departing from the scope of the invention.

I claim:

1. An applicator for the application of a pasty, liquid or semi liquid cosmetic product comprising:

an elongate member having a product-retaining portion comprising elements or material for retaining the cosmetic product; and a cover member for at least partially covering said elements or material of said product-retaining portion;

said elongate member and said cover member being relatively movable to vary the covering of said elements or material of said product-retaining portion by said cover member.

2. An applicator according to claim 1 wherein said elongate member and said cover member are relatively movable so as to permit varying amounts of the product-retaining portion to be exposed for use.

3. An applicator according to claim 1 wherein said elongate member and said cover member are relatively movable between a first relative position in which the product retaining portion is fully exposed for use and a second relative position in which it is fully covered.

4. An applicator according to claim 1 wherein said elongate member and said cover member are relatively movable so as to alter the configuration of the product-retaining portion.

5. An applicator according to claim 1 wherein said cover member comprises a sleeve disposed over said elongate member.

6. An applicator according to claim 5 wherein said product-retaining portion is an end portion of said elongate member and wherein said sleeve and said elongate member are relatively axially movable to vary the amount of the material retaining portion which projects from an open end of said sleeve.

7. An applicator according to claim 5, wherein said product retaining portion is an end portion of said elongate member, and wherein a corresponding end portion of the sleeve is adapted so that relative rotation between the sleeve and the elongate member causes said end portion of the sleeve variably to cover said product retaining portion.

8. An applicator according to claim 5, further comprising manually operable means for producing relative movement between said sleeve and said elongate member.

9. An applicator according to claim 8 wherein said manually operable means comprises a handle having a first part to which one of said sleeve and elongate member is fixedly attached and a second part which is movable relative to the first part; and means coupling said second part to the other of said sleeve and elongate member, said coupling means causing the relative movement between said sleeve and elongate member in response to the relative movement between said first and second parts.

10. An applicator according to claim 9 wherein said one of said sleeve and elongate member which is fixedly attached to said first part of the handle is said sleeve.

11. An applicator according to claim 9 wherein said handle is a closure cap adapted to be secured to the neck of a container for the cosmetic material with the sleeve and elongate member projecting into said container.

12. An applicator according to claim 4 wherein said product retaining portion comprises a central support stem a forward end of which carries a multiplicity of flexible, circumferentially spaced radially projecting filaments, such as bristles or teeth, constituting paid elements, and wherein said cover member comprises a sleeve disposed over said elongate member, said sleeve having a forward end opening which, when the sleeve moves forwardly or the elongate member moves rearwardly, engages behind said filaments and causes them to flex to an axially forwardly projecting orientation to form an axial end brush projecting forwardly of said end of said stem.

13. An applicator according to claim 12 wherein said forward end opening of said sleeve has an inwardly inclined frusto-conical surface to engage said filaments.

14. An applicator according to claim 13 wherein said filaments are adapted to be flexed forwardly by engagement by said frusto-conical surface, the forward flexing causing the filament tips to meet on the axis so that the filaments form a circumferential curtain enclosing a central reservoir for the cosmetic material.

15. An applicator according to claim 6 wherein said product-retaining portion comprises a central stem with said product-retaining elements or material projecting radially therefrom, and wherein said open end of said sleeve comprises an opening through which the stem can project, and which is smaller than the internal cross-sectional area of the sleeve so that as the product-retaining elements or material enter the sleeve through said opening a radially inner part of said elements or material is wiped, and thereby cleaned, by said opening.

16. An applicator according to claim 3 wherein said elongate member comprises a shaft, and wherein said product-retaining portion comprises a plurality of flexible filaments extending substantially axially from one end of the shaft to form a brush, said cover member comprising a sleeve within which said shaft is disposed, said elongate member and said sleeve being relatively axially displaceable so that in said first relative position said brush projects from said sleeve and in said second relative position said brush lies wholly within said sleeve.

17. An applicator according to claim 1 wherein said cover member includes on an outer surface thereof surface formations constituting a further product retaining portion which can be used for product retention and application 18. An applicator according to claim 1 wherein said product-retaining portion is a brush comprising a multiplicity of bristles.

19. An applicator according to claim 18 wherein said brush comprises a support stem from which said bristles project laterally.

20. A cosmetic applicator for a pasty, liquid or semi liquid cosmetic product, comprising:

a central elongate member having a portion including a stem and a plurality of elements projecting laterally from said stem; and a cover member for at least partially covering said portion of said elongate member;

wherein the cover member and elongate member are relatively movable to vary the covering of said portion of said elongate member by said cover member, and wherein an outer part of said cover is provided with means for retaining the cosmetics product thereon.

* * * * *

UNITED STATES PATENT AND TRADEMARK OFFICE

CERTIFICATE OF CORRECTION

PATENT NO. : 4,598,723

DATED : July 8, 1986

INVENTOR(S) : Rodney D. Cole

It is certified that error appears in the above-identified patent and that said Letters Patent is hereby corrected as shown below:

Column 8, line 17, "material" should read --product--.
Column 8, line 51, "paid" should read --said--.

Signed and Sealed this

Twenty-fifth Day of November, 1986

*Attest:*

DONALD J. QUIGG

*Attesting Officer* *Commissioner of Patents and Trademarks*

Notice of Adverse Decision in Interference

In Interference No. 102,063, involving Patent No. 4,598,723, R. D. Cole, MATERIAL APPLICATOR, final judgment adverse to the patentee was rendered July 20, 1989, as to claims 1-20.

[*Official Gazette September 19, 1989.*]